US006702766B2

(12) United States Patent
Guitay

(10) Patent No.: US 6,702,766 B2
(45) Date of Patent: Mar. 9, 2004

(54) MASSAGE APPARATUS COMPRISING AT LEAST ONE ROLLER DRIVEN POSITIVELY IN ROTATION

(76) Inventor: Louis-Paul Guitay, Résidence du Soleil A, CH-3963 Crans sur Sierre (CH)

( * ) Notice: Subject to any disclaimer, the term of this patent is extended or adjusted under 35 U.S.C. 154(b) by 9 days.

(21) Appl. No.: 10/305,468

(22) Filed: Nov. 26, 2002

(65) Prior Publication Data

US 2003/0073937 A1 Apr. 17, 2003

Related U.S. Application Data

(63) Continuation of application No. PCT/FR01/01739, filed on Jun. 6, 2001.

(51) Int. Cl.[7] ..... A61H 7/00; A61H 23/02
(52) U.S. Cl. ..... 601/6; 601/126; 601/133
(58) Field of Search ..... 601/6, 8, 9–11, 601/126, 136; 604/313, 315, 316

(56) References Cited

U.S. PATENT DOCUMENTS

| | | | | |
|---|---|---|---|---|
| 2,574,601 A | | 11/1951 | Swanson | 128/67 |
| 3,297,024 A | | 1/1967 | Robinson | 128/38 |
| 4,729,368 A | | 3/1988 | Guitay | 128/57 |
| 4,883,047 A | | 11/1989 | Guitay | 128/38 |
| 5,665,053 A | * | 9/1997 | Jacobs | 601/6 |
| 5,711,758 A | | 1/1998 | Tseng | 601/127 |
| 5,885,232 A | | 3/1999 | Guitay | 601/6 |
| 6,017,320 A | * | 1/2000 | Bleeker et al. | 601/6 |
| 6,312,396 B1 | * | 11/2001 | Muller | 601/6 |
| 6,319,212 B1 | * | 11/2001 | Muller et al. | 601/6 |
| 6,585,667 B1 | * | 7/2003 | Muller | 601/6 |

FOREIGN PATENT DOCUMENTS

| | | |
|---|---|---|
| CH | 168279 | 6/1934 |
| EP | 0 224 422 | 6/1987 |
| FR | 409.202 | 7/1909 |
| FR | 727.291 | 12/1931 |
| FR | 901.787 | 8/1945 |
| FR | 1.225.094 | 6/1960 |
| FR | 1.590.131 | 4/1970 |
| FR | 2 579 100 A1 | 9/1986 |
| FR | 2 579 100 B1 | 9/1986 |
| FR | 2 749 755 | 12/1997 |
| WO | WO 94/21210 | 9/1994 |

* cited by examiner

*Primary Examiner*—Danton D. DeMille
(74) *Attorney, Agent, or Firm*—Heslin Rothenberg Farley Mesiti P.C.; Victor A. Cardona

(57) ABSTRACT

Massage apparatus consisting of a treatment head connected to a suction circuit, the said treatment head comprising a box (B) that can be operated manually, comprising an internal chamber (C) open at its base, which chamber is defined by two fixed side walls (P1, P2) and two transverse surfaces (T1, T2) arranged facing one another between the two side walls (P1, P2), at least one of these surfaces (T1) consisting of the periphery of a roller (1) driven positively in rotation, the suction circuit opening into the said chamber (C) and making it possible to create suction when the apparatus is applied against the body of the patient, which suction tends to form a fold of skin pressing against the transverse surfaces (T1, T2), characterized in that the positive drive of the roller (1) is obtained via a geared motor unit mounted fixed and coaxially inside it, and in which the output shaft (5) of the reduction gear comprises means of coupling to the said roller (1), the said apparatus being associated with means for adjusting the speed and/or direction of rotation of the motorized roller(s) and the amount of suction, possibly varying this, and doing so during operation.

16 Claims, 7 Drawing Sheets

MASSAGE APPARATUS COMPRISING AT LEAST ONE ROLLER DRIVEN POSITIVELY IN ROTATION

CROSS REFERENCE TO RELATED APPLICATIONS

This application claims priority from French patent application 00.07399, filed on Jun. 9, 2000, and International Application No. PCT/FR01/01739, filed on Jun. 6, 2001, and published in French on Dec. 13, 2001, as WO01/93799, the entire disclosures of which are incorporated herein by reference.

Technical Field

The present invention relates to a new type of massage apparatus that can be used with equal ease on human beings and on animals (horses, cattle, etc.), and more particularly to massage apparatus in which an action of sucking and mobilizing the skin tissue is performed on the subject.

Prior Art

Various massage techniques have been used to date, depending on the treatment to be performed, but it can be said that they all involve exerting on the subject stresses which involve phenomena of pressing and/or displacing and/or pinching the skin tissue.

To date, a huge amount of apparatus has been proposed for making the masseur's work easier.

Among the various solutions proposed, the very first idea was to use gadgets involving a simple mechanical action, for example using assemblies comprising various types of ball mounted on a support housing, possibly allowing a treatment product (cream, liquid) to be dispensed, as is apparent from FR-A-1 225 094.

Elsewhere it was proposed, as is apparent from FR-A-901 787, to produce massage apparatus consisting of a treatment head connected to a suction circuit, the said treatment head consisting of a box which comprises an internal chamber into which the said suction circuit opens. This box is in the form of a bell housing open at its base, the lower edge of which is generally of a rounded shape. When the gadget is applied to the body of the patient, a fold of skin is formed inside the bell housing, which fold of skin presses directly against the peripheral edge of this housing.

A gadget such as this, of simple design, is relatively tricky to use, is difficult to displace over the body of the patient and simply exerts a "suction cup" action.

Numerous other solutions, as is apparent from CH-A-168 279, U.S. Pat. Nos. 2,574,601, 3,297,024, FR-A-409 202, FR-A-1 590 131, have proposed combining with a suction phenomenon a mechanical action exerted by rollers, balls, etc., which give rise to an action of pressing and/or displacing and/or friction vibration.

The solutions proposed in those documents lead to assemblies which are complicated, tricky to operate and not entirely satisfactory.

More recently, various types of massage apparatus have been proposed which make it possible, in a simple and effective way, to perform massages of the "squeezing and rolling" type, making it possible to exert a continuous action on the patient, giving rise not only to localized pinching but also to a gradual displacement of the pinched area, so as to give rise to "rolling", and for all this to be done while at the same time exerting pressure.

Such apparatus is, in particular, the subject matter in particular of FR-A-2 579 100 and patents EP-A-0 224 422, EP-A-0 284 527 and EP-A-0 774 947 (these patents corresponding respectively to patents U.S. Pat. Nos. 4,729,368, 4,883,047 and U.S. Pat. No. 5,885,232).

In general, the apparatus described in the aforementioned documents comprises, mounted inside a box that can be operated manually, two parallel rollers, preferably with a smooth surface, mounted so that they are free or driven positively in rotation inside the box.

These rollers may be mounted on the box either with a fixed distance between centres or so that they can move apart and move closer together automatically during the massage operation.

The box is connected to suction means via a pipe, the end of which opens into the space between the rollers, this then making it possible to create suction between these rollers when they are applied to the body of the patient, so as to form a fold of skin pressing against the surfaces of the rollers.

When one or all the roller(s) are driven in rotation (cf. FR 2 579 100 or EP 0 224 422), such drive is obtained by means of a geared motor unit, supplied with low voltage DC current with or without a variation in speed. The movement imparted by the motor is transmitted to one or both rollers via a toothed belt, chain or other conventional transmission means.

In document EP-A-0 224 422, when the two rollers are driven positively in rotation, such drive is obtained by a belt or chain which connects the output shaft of the motor to sprockets provided at the end of each of the axles of the rollers, the said belt or chain also passing around an intermediate deflection roller so that both rollers rotate in the same direction and are always correctly driven irrespective of their position, the movement of the said rollers therefore being in a curve centred on the geometric axis of rotation of the output shaft of the motor.

In such an embodiment, the two rollers always rotate in the same direction and at the same speed, which means that it is not possible to imagine adapting their action according to the treatments which may sometimes demand different operating conditions.

This type of gadget, whether it has rollers which are motorized or ones which are mounted so that they can rotate freely, therefore makes it possible to perform massages of the "squeezing and rolling" type and its field of application has not stopped expanding ever since it appeared. Specifically, at the present time, it is used not only for performing conventional massage treatments such as simple wellbeing massages, restorative massages, for example for athletes, and rehabilitation massages, but also for treating cellulite, to promote better scarring in burns patients and for reducing the scarring resulting from operations, accidents, etc.

Now, it has become increasingly apparent that the dimensions of the apparatus and their operating conditions need to be tailored to suit the treatment to be carried out. Hence, it is obvious that the strength of the suction action has to differ according to the application, while at the same time taking hold of the same fold of skin.

In consequence, there is now the problem of having multifunction apparatus in which it is possible to be able to adjust and possibly vary the speed of the rollers one with respect to the other and/or their direction of rotation, so as to obtain top quality treatment even with less suction.

There is also the problem of being able periodically to reverse the direction of rotation of one of the rollers with respect to the other during treatment.

In certain cases, it is necessary to be able to produce phenomena of vibration, alternating pinching, and to form the fold of skin with a minimum amount of suction.

This is because it has become apparent that, in certain cases, particularly when treating burns patients, the forming of the fold which, in earlier apparatus resulted essentially from the suction, is sometimes prejudicial.

In consequence, there is therefore the problem of producing apparatus which makes it possible to monitor the pressure exerted by the rollers on the fold of skin, the amount of suction exerted in the chamber and the speed of rotation of one or both rollers, these rollers rotating either at the same speed or at different speeds, and possibly having a direction of rotation that is periodically reversed.

Likewise, there is also the problem of being able to incorporate into the said apparatus means that will allow the effect of the treatment to be viewed.

Finally, there is the problem of being able to produce motorized apparatus which is as compact as possible and easy to handle.

SUMMARY OF THE INVENTION

Now, there has been found, and this is what forms the subject of the present invention, a novel type of massage apparatus involving an action of sucking and mobilizing skin tissue, which makes it possible to solve all of the aforementioned problems.

In general, the massage apparatus according to the invention consists of a treatment head proper connected to a suction circuit. This treatment head comprises a box that can be operated manually, and comprises an internal chamber open at its base, which chamber is defined by two fixed side walls and two transverse surfaces arranged facing one another between the aforementioned side walls.

In apparatus such as this, at least one of the transverse surfaces consists of the periphery of a roller driven positively in rotation. The suction circuit opens into the chamber and makes it possible to create suction when the apparatus is applied against the body of the patient, which suction tends to form a fold of skin pressing against the transverse surfaces.

The apparatus according to the invention is characterized in that the positive drive of the roller is obtained via a geared motor unit mounted fixed and coaxially inside it, and in which the output shaft of the reduction gear comprises means of coupling to the said roller, the said apparatus being associated with means for adjusting the speed and/or direction of rotation of the motorized roller(s) and the amount of suction, possibly varying this, and doing so during operation.

It is possible to imagine producing apparatus in which the transverse active surface facing the motorized roller consists of a simple curved surface, it being possible for the spacing between these two surfaces during operation to be either constant or variable.

According to one embodiment, the apparatus according to the invention comprises two transverse rollers which may be mounted on the box either with a fixed distance between centres or such that they can automatically move closer together under the effect of the suction, just one of these rollers, but preferably both of them, being motorized.

In this embodiment, there may be side valves and/or pivoting flaps pressing against the rollers so as to seal the treatment chamber formed between the side walls and the surface of the said rollers when the apparatus is applied against the body of the patient.

In the embodiments which comprise two motorized rollers, control of these rollers is thus independent of one another and makes it possible, as desired, for the direction of rotation and/or the speed of the rollers one with respect to the other to be tailored to suit the direction of displacement of the head and/or the treatment to be performed, and making it possible to adjust the amount of suction thus making it possible to vary these parameters during treatment or according to the treatment to be performed.

Moreover, it has been found that this possibility of making the two rollers rotate at different speeds, allow them to be made to play a part in forming the fold of skin in collaboration with the suction produced inside the treatment chamber, it possibly being possible for the amount of suction to be reduced.

Such a possibility of having a speed differential between the two rollers therefore makes it possible to imagine adjusting the height of the fold inside the chamber while at the same time using less suction. This possibility also offers the advantage of new skin gymnastics, through the various possible combinations of dragging and mobilizing.

Furthermore, it is also possible for the direction of rotation of the two rollers to be reversed periodically one with respect to the other. This temporary reversal of the direction of rotation of the rollers one with respect to the other also offers a great benefit for treating scar tissue and for skin toning.

These various possibilities therefore make it possible to imagine carrying out not only conventional treatments of the "squeezing and rolling" type but also new types of massage tailored to each particular circumstance.

Furthermore, such a design in which the roller has a built-in motor, makes it possible to produce assemblies which are far more compact by comparison with apparatus in which the rollers are driven by an external motor and, above all, allows an instant reaction owing to the absence of transmission members, making it possible to imagine treatments involving a combination of stopping, accelerating, reversing, vibrating, etc.

According to a preferred embodiment of the invention, each motorized roller that the apparatus has is characterized in that:

- it consists of a cylindrical sleeve which can be driven in rotation, preferably about its geometric axis but possibly around an off-centred axis, the said sleeve being mounted at each of its ends on rolling bearings, the fixed bearings of which, together with the end edges of the said sleeve, form the side faces of the roller;
- the sleeve is driven in rotation about the bearings by a geared motor unit mounted fixed and coaxially inside it, and in which the output shaft of the reduction gear comprises means of coupling with the said sleeve;
- the end edges of the sleeve are in sliding contact with the surfaces of the side walls of the box inside which the roller is mounted,
- the said roller is fixed between the side walls, so as to constitute the treatment chamber proper, via connecting means which, on the one hand, immobilize the geared motor unit inside the sleeve and, on the other hand, provide electrical power and the connection to additional means used for operating and monitoring the various functions that the apparatus has to fulfil, namely:
  - adjusting the speed and direction of rotation of the motorized roller or rollers, with the possibility for programmed or unprogrammed reversal, and the possibility of varying the speed of one roller with respect to the other and the direction of rotation of one of the rollers with respect to the other;

adjusting the amount of suction, and possibly varying this during operation;

possibly monitoring the pressure exerted by the rollers on the fold of skin formed.

According to one embodiment, the connecting means consist of connecting blocks which pass through slots provided in the side walls and which can slide in the slots so as to allow the rollers to move closer together under the effect of the suction.

According to an alternative form, the connecting means of the rollers consist of two end plates bearing against the side walls, which end plates are joined together by a transverse spacer piece so as to form a fork mounted so that it can pivot inside the box and ensuring sealing when the apparatus is applied against the body of the patient, the said rollers normally being held apart and being capable of moving closer together under the effect of the suction.

In these embodiments, the sleeve may be covered with a removable sheath which may either have a hygienic function and/or act as a support for a treatment product.

Such a design of apparatus may also make it possible to imagine having rollers, the surface of which can be heated simply by supplying heat from the motor, for example by making the outer sleeve from a material which is a good conductor of heat.

By contrast, if it is desirable to avoid the sleeve heating up during operation, that can be obtained simply by making the said sleeve out of a material which is not a conductor of heat.

According to a preferred embodiment, the sleeve is thermally insulated by placing the geared motor unit inside a tube, for example made of aluminium, which not only forms an insulating cage but also acts as a bearing for one of the rolling bearings provided at the end of each roller.

In this embodiment, an inner bearing is provided on the side of the reduction gear so as to immobilize the body thereof, this bearing supporting an intermediate roller.

A roller of this type, which, in the remainder of the description, will be known by the expression "motorized roller", can be used for producing various types of massage head involving an action of sucking and of mobilizing the skin tissue, in which apparatus the treatment head proper comprises a box with an internal chamber, into which there opens the outlet of a suction circuit of the type, and comprising two parallel rollers mounted either with a fixed distance between centres as described in EP-A-0 284 527 or with a varying distance between centres, it being possible for the rollers to move apart and move closer together automatically during the massage operation, as described in EP 0 224 422 or EP 0 774 947, the said apparatus being characterized in that at least one of the rollers is motorized in accordance with the invention, and they are mounted on the side walls of the box via connecting means consisting either of connecting blocks passing through slots made in the side walls or by two pivoting end plates bearing against the surfaces of the side walls and connected together by a transverse spacer piece mounted so that it can pivot inside the box.

In the embodiment in which the connections are made by means of connecting blocks passing through slots, it is possible to produce either apparatus in which the two rollers are mounted with a fixed distance between centres, in which case the said slots have dimensions which correspond to those of the said connecting blocks, or a variable distance between centres, the rollers normally being held apart under the action of return means (springs) and being capable of moving closer together under the action of the suction, the length of the said slots defining the magnitude of displacement.

In a known way, the displacement of the two rollers will be contrived so that their separation can vary between two predetermined positions, the maximum spacing being obtained by means of a pushing means (spring) which acts on the connecting blocks and they are moved closer together under the effect of the suction produced inside the treatment chamber.

By comparison with apparatus of the prior art, the solution according to the invention therefore makes it possible to produce very compact massage heads, the volume of which is more or less equivalent to heads in which the rollers are not motorized but are simply free to rotate inside a box connected to a source of suction.

In addition, such a design of massage apparatus where the motorizing of the roller or rollers is built into the roller itself and in which mounting onto the side walls is via removable connecting blocks, makes the said rollers easier to remove, particularly for cleaning the apparatus.

By comparison with the apparatus of the prior art, particularly the apparatus as described in EP 0 224 422, the fact that the drive motor is incorporated inside the rollers makes it possible to have independent displacement for each roller. It is therefore possible to alter the positioning of the said rollers with respect to the lower edges of the side walls of the box, and to do so simply by modifying the shape of the slots in which the connecting blocks slide.

Thus, it is possible to have a parallel displacement at the base of the side walls, which may be either flat or curved (just as easily concave as convex), having slots with the same profile as these bases. As a preference, as in the solutions of the prior art, in such a case, the rollers protrude slightly from the bases of the side wall, for example by a few tenths of a millimetre.

It may also be imagined for there to be slots, the shape of which is such that the position of the peripheral surface of the rollers with respect to the lower face of the box can vary between a position set back slightly and a position protruding slightly with respect to this face.

Conventional means such as side valves, pivoting flaps pressing against the rollers, may be provided, so as to seal the treatment chamber formed between the side walls and the surface of the said rollers when the apparatus is applied to the patient's body.

Finally, according to a preferred embodiment, the box supporting the rollers has two side walls in the form of a casing (or housing), associated with one another via a hood connected to a suction source. The two rollers are mounted parallel between the two faces of this casing that face each other, which faces have slots for the connecting means which are arranged inside the said casing.

The connecting blocks which pass through the slots are, for their part, mounted on blocks which protrude from the said slots, and may possibly seal them.

In this embodiment, valves are mounted on each block to make the seal at the slots when the rollers move.

These blocks may, if the rollers can move, act as support for springs which bear against a fixed central wall and tend to hold the rollers apart.

There may also support detectors allowing the pressure exerted by the rollers to be constantly monitored.

Means for viewing the fold of skin formed may be incorporated in the hood. The simplest means consist in making the said hood out of a material which is completely or partly transparent, possibly forming a magnifying glass.

It may also be imagined for a camera looking at the treated area to be included inside the hood.

BRIEF DESCRIPTION OF THE DRAWINGS

The invention and the advantages it affords will, however, be better understood by virtue of the description which follows and of the exemplary embodiments given hereinafter by way of non-limiting indication and which are illustrated by the appended diagrams in which:

FIGS. 1, 2 and 3 are schematic views of massage apparatus produced according to the invention, in which:

FIG. 1 is a view in elevation of apparatus comprising a single motorized roller, it being possible for the other transverse wall to consist either of a curved surface or of a roller mounted to rotate freely, FIG. 2 illustrates an embodiment comprising two motorized rollers mounted with a fixed distance between centres, and FIG. 3 schematically illustrates an embodiment in which the two rollers are motorized and can be automatically parted or brought closer together;

EMBODIMENTS OF THE INVENTION

Figure 1:
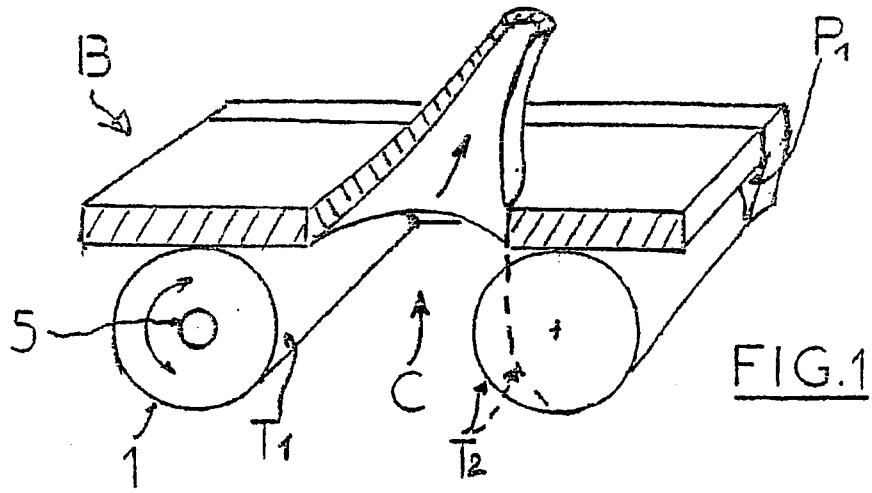
Figure 2:
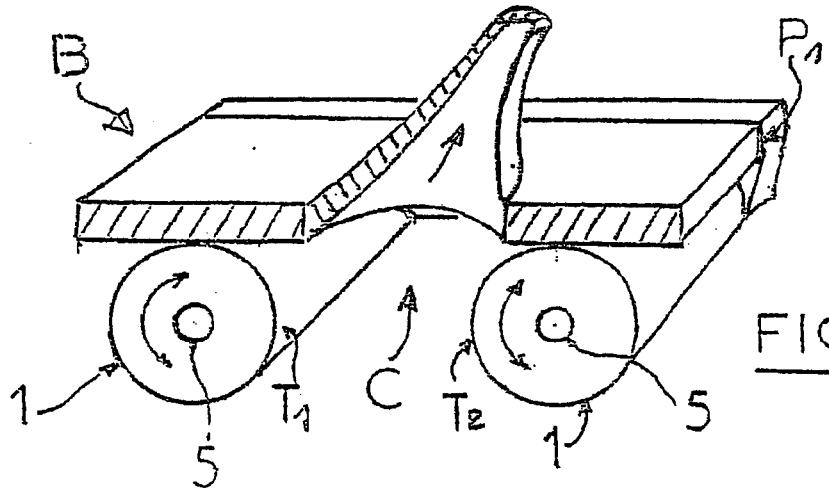
Figure 3:
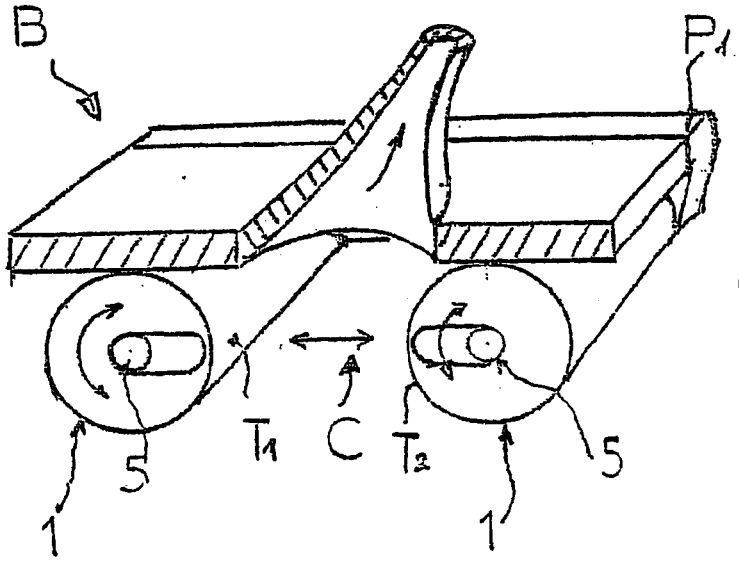
Figure 4:
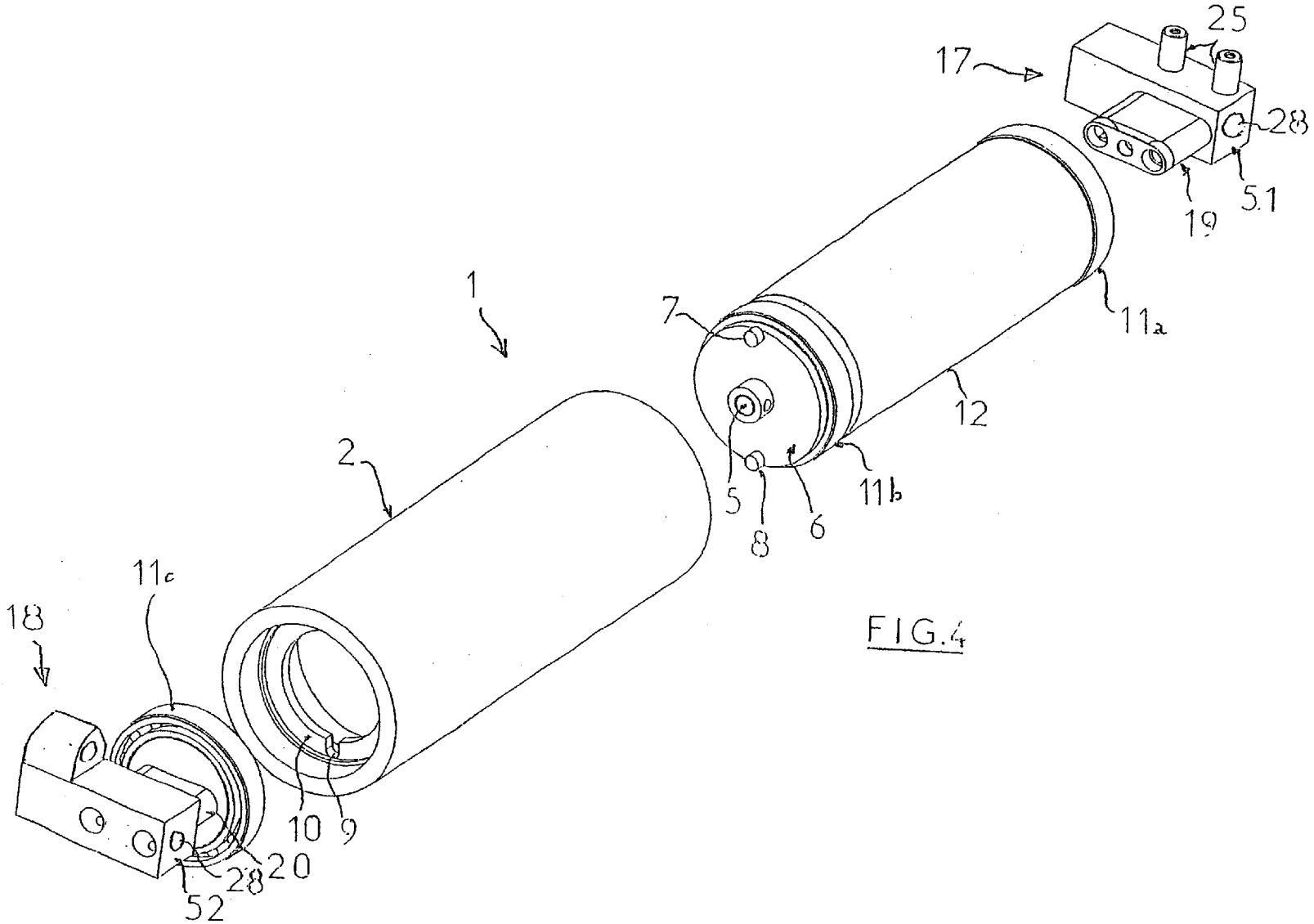
FIGS. 4 and 5 are exploded perspective views showing the general structure of a motorized roller that can be used for producing a massage head according to the invention.
Figure 5:
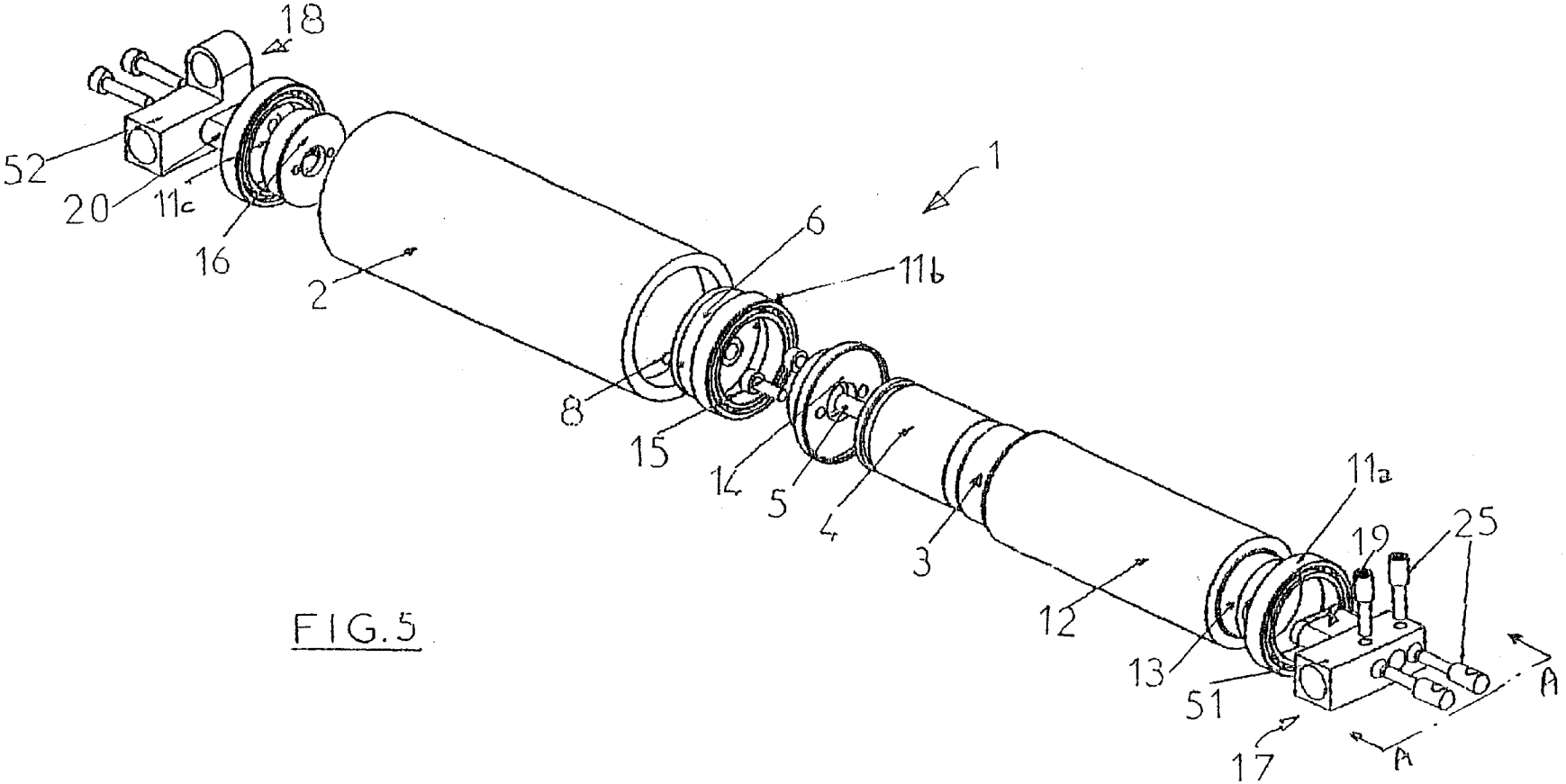

FIGS. 1 to 3 illustrate, schematically and in perspective, various general forms of massage apparatus produced according to the invention.

In general, this massage apparatus is of the type whereby an action of suction and of mobilizing the skin tissue is exerted on the subject.

This apparatus consists of a treatment head proper, connected to a suction circuit and which comprises a box (B) which can be operated manually, comprising an internal chamber (C) open at its base. This chamber (C) is defined by two fixed side walls (P1, P2) and two transverse surfaces (T1, T2) arranged facing one another between the two side walls.

At least one of these transverse surfaces (T1, T2) consists of the periphery of a roller, denoted by the general reference (1), driven positively in rotation. The suction circuit opens into the chamber (C) and makes it possible to create suction when the apparatus is applied to the body of the patient, which suction tends to form a fold of skin pressing against the transverse surfaces (T1, T2).

In each of the various types of apparatus illustrated in FIGS. 1 to 3, the positive drive of the roller or of each roller (1) that the apparatus has is obtained via a geared motor unit (not depicted in FIGS. 1 to 3) of which the output shaft (5) of the reduction gear comprises means of coupling to the said roller (1).

The apparatus is associated with means for adjusting the speed and/or the direction of rotation of the motorized roller(s) and the amount of suction, possibly varying the latter, and doing so during operation, such means being seen in greater detail in the remainder of the description.

FIG. 1 illustrates one embodiment comprising a single motorized roller (1) which therefore constitutes the active surface (T1). The other active surface (T2) may consist of a simple curved surface, illustrated in dotted line, it being possible for the spacing between the two surfaces (T1) and (T2) to be fixed or variable.

It is possible, as is also apparent from this FIG. 1, that the second surface (T2) might consist of a second roller mounted so that it can rotate freely facing the roller (1), be this with a fixed distance between centres or in such a way that these rollers can move apart and move closer together automatically.

FIG. 2 illustrates an embodiment according to the invention, in which the two surfaces (T1, T2) consist of motorized rollers (1), the said rollers being mounted with a fixed distance between centres, while FIG. 3 illustrates an embodiment in which the two motorized rollers can move apart and move closer together automatically under the effect of the suction.

Figure 7:
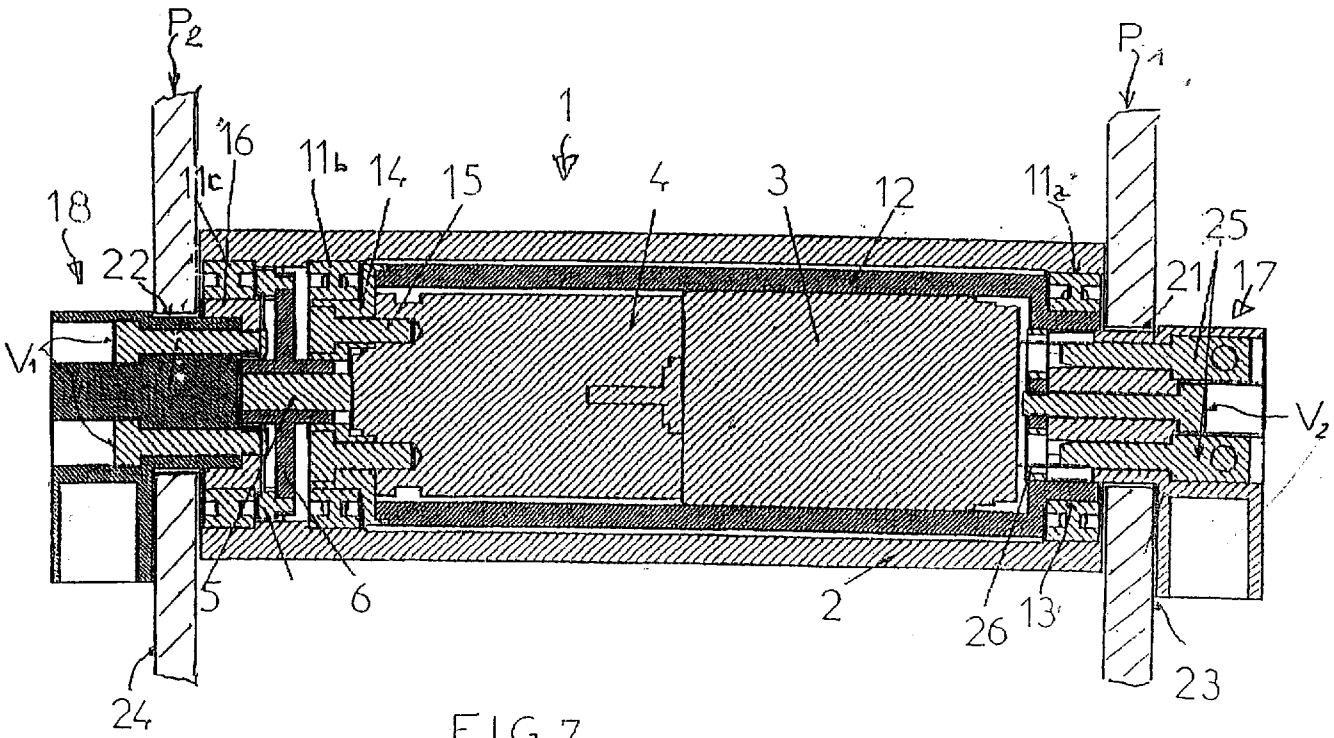
FIG. 6 is an end-on view of such a massage roller and FIG. 7 is a view in section on the plane AA passing through the axis of rotation of the said roller.
Figure 6:
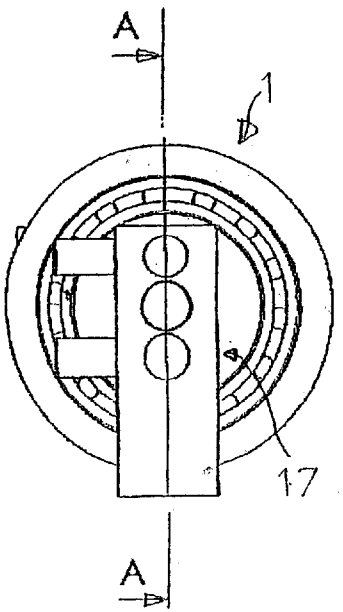
Figure 9:
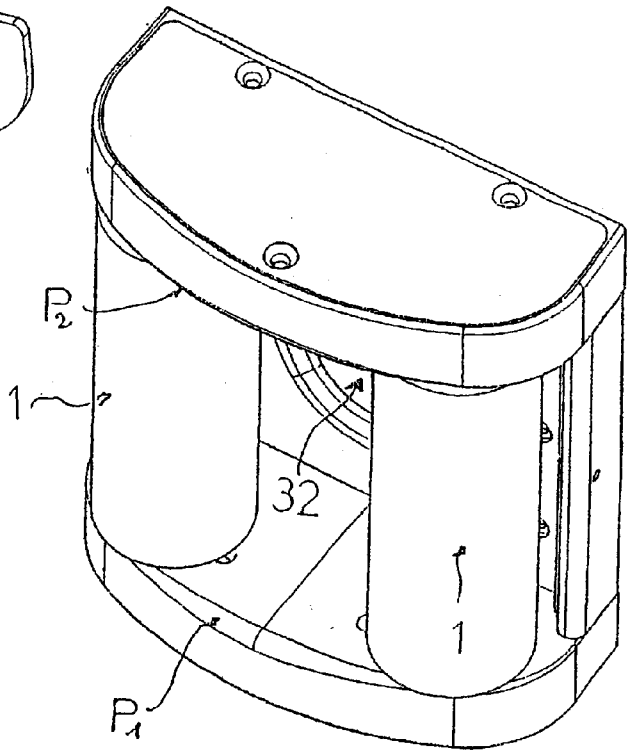
FIG. 9 is a perspective view showing the general structure of apparatus illustrated in FIG. 8 after these various constituent parts have been mounted.
Figure 8:
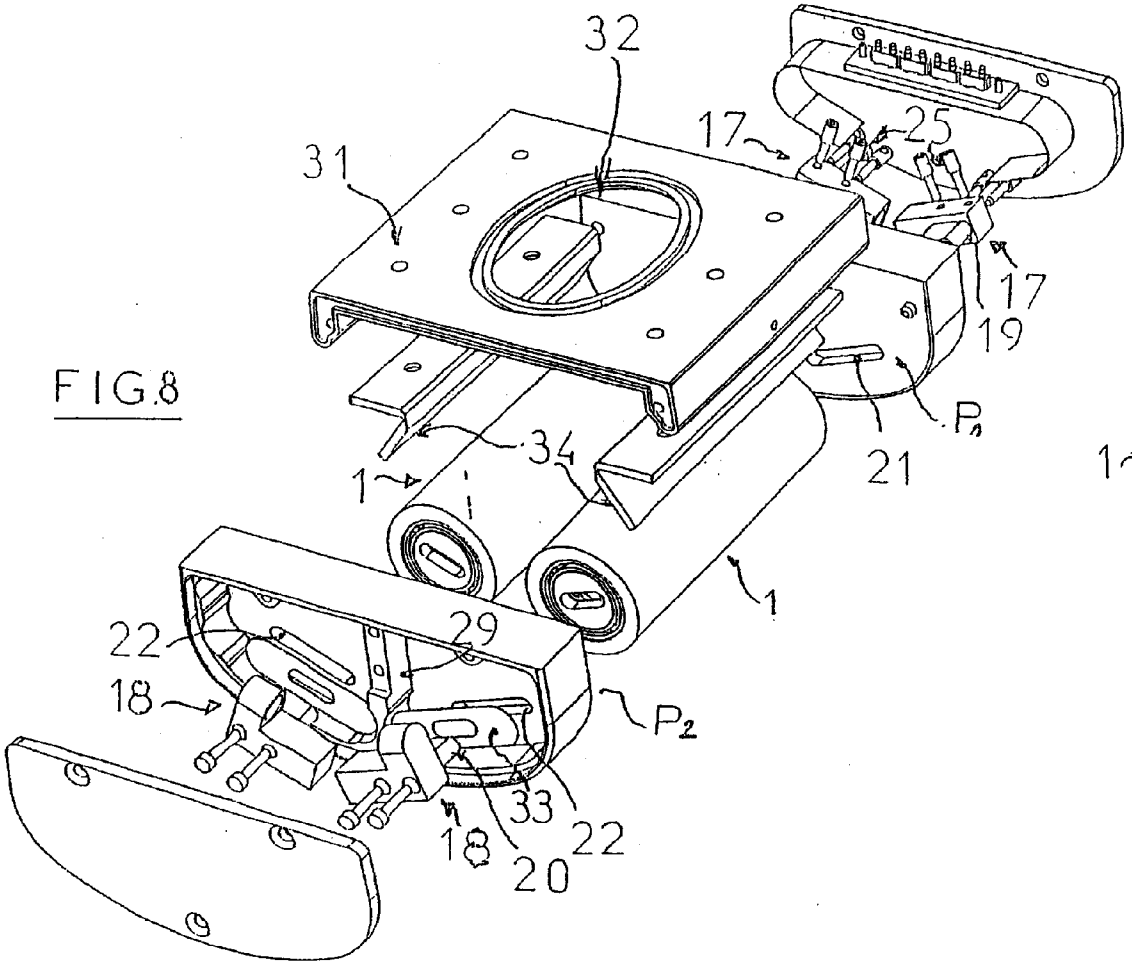
FIG. 8 is an exploded perspective view of a massage head according to the invention incorporating motorized rollers and in which the separation between the rollers can vary automatically during the massage operation.

FIGS. 4 to 7 illustrate in detail one embodiment of a motorized roller for producing apparatus according to the invention, FIGS. 8 and 9 illustrating, in an exploded view and in a perspective view from underneath, the structure of massage apparatus in which the two rollers are motorized according to this embodiment and can move closer together and further apart automatically under the effect of the suction during operation.

In FIGS. 4 to 7, the side walls (P1, P2) of the box are depicted schematically only in FIG. 7.

In general, massage apparatus according to the invention therefore comprises at least one roller driven positively in rotation by a built-in motor, a preferred embodiment of which roller is illustrated in FIGS. 4 to 7.

In this embodiment, the roller denoted by the general reference (1) is therefore essentially made up of a cylindrical sleeve (2) which constitutes the active element in contact with the subject to be treated. The diameter and the length of this cylindrical sleeve (2) will depend on the type of apparatus that it is desired to produce.

By way of indication, the sleeve (2) may have an outside diameter of between 20 and 30 mm for a length that may be between 60 and 70 mm.

Of course, it may be conceivable to produce rollers of smaller or larger sizes, this depending on the area of the regions to be treated. It may also be conceivable to have rollers of different diameters, or even to produce apparatus containing more than two rollers, for example a motorized central roller on each side of which is arranged one of two rollers of smaller diameter or of the same diameter, so as to form two folds of skin.

The sleeve (2) may have a smooth exterior surface or, on the other hand, may have a surface which may exhibit roughnesses or relief, depending on the treatments to be carried out.

A sleeve such as this could possibly be covered with a removable sheath, having a hygienic function and/or acting as a support for a treatment product.

It might be made of a material that is a good conductor of heat, allowing it to heat up simply by taking heat energy from the motor, or may be made of an insulating material, when its heating is to be avoided.

The rotational drive of the sleeve (2) is achieved via a motor (3) and reduction gear (4) assembly, mounted fixed coaxially inside the said sleeve (2).

By way of geared motor unit (M) use will be made of a conventional geared motor unit, supplied with low-voltage DC current, for example at 24 volts.

According to the invention, in the embodiment illustrated in FIGS. 4 to 7, the output shaft (5) of the motor which, as stated earlier, is mounted fixed in terms of rotation inside the sleeve as will be seen in the remainder of the description, supports means of coupling with the said sleeve (2), the means consisting of a disc or plate (6) secured to the shaft (5), securing being obtained, for example, by adhesive bonding. This disc (6) has two diametrically opposed lugs (7, 8), which lugs fit into corresponding recesses (9) (only one being visible in FIG. 4) formed in an internal ring (10) of the sleeve (2).

In consequence, when the geared motor unit (3, 4) is powered, the output shaft (5) therefore drives the rotation of the disc (6) which, in turn, drives the rotation of the sleeve (2).

The sleeve (2) can be driven in rotation about the geared motor unit by mounting it on rolling bearings **(11*a*, 11*b*, 11*c*)**.

The rolling bearings **(11*a*, 11*b*) are mounted at each end of the geared motor unit on fixed bearings (13, 14). In this embodiment, in order to provide insulation, the geared motor unit (3, 4) is surrounded by a tube (12), for example made of aluminium, secured to the body of the motor (3). The end bearing (13) in this case consists of a bearing surface formed at the end of the tube (11), the said tube therefore forming not only an insulating cage but also acting as a support for this end peripheral rolling bearing (11*a*)**.

The rolling bearing **(11*b*) is, for its part, mounted on a bearing (14) consisting of a flange by means of a screw (15) to the reduction-gear box (4), thus immobilizing the latter and allowing the shaft (5)** of the reduction gearing to pass.

Finally, the third rolling bearing **(11*c*) is mounted so that it rests against the internal ring (10) of the drive disc (6) carrying the lugs (7, 8), this being via a fixed bearing (16)**.

By virtue of such a design, an assembly is obtained which is perfectly sealed, the end faces of which have no protruding parts, the end edges of the sleeve (2), which are therefore in the form of a flat and smooth ring being capable of coming into sliding contact with the interior surfaces of the side walls (P1, P2) of the chamber of the box inside which the roller is mounted.

According to the invention, the two rollers (100) are fixed between the side walls (P1, P2) of the chamber by removable connecting blocks denoted by the general references (17, 18), each connecting block having a connecting guide proper (19, 20), of oblong shape, capable of passing through slots (21, 22) made in each side wall (P1, P2) so as to fit into complementary regions provided at each end of the bearings (13, 16) that each roller (1) has.

Each bearing connecting guide (19, 20) is associated, for example via screws, with two blocks (51, 52) which for their part bear against the exterior face (23, 24) of each side wall.

In the example illustrated, the block (18) is attached using two screws (V1) arranged one on each side of the axis of rotation and the block (19) is attached using a single screw (V2) which, for its part, is fixed into the axis of rotation.

The connecting block (17) supports the electrical connections (25) with the connecting tabs (26) provided on the motor (M) and with the additional means that allow the various functions that the apparatus fulfils to be controlled and monitored, namely:

- the adjustment of the speed and of the direction of rotation of the motorized roller(s),
- the adjustment of the amount of suction and possibly the varying thereof, according to the treatment; it has been found that with apparatus of such a type, it is conceivable to have a much lower level of suction, particularly when the rollers are driven at different speeds from one another, because they then tend to play a part in forming the fold inside the chamber;
- the periodic and temporary reversal of the direction of rotation of the rollers so that they rotate in opposite directions to one another;
- the monitoring of the pressure exerted by the rollers against the fold of skin formed.

The electrical connections (25) are connected to the general control circuit using flexible links capable of accompanying any movements that may be imparted to the rollers in certain embodiments.

The motorized rollers thus produced can be used to produce various types of massage head involving an action of suction and a mobilization of skin tissue, and in which the treatment head proper comprises a box having an internal chamber defined by two side walls and the surfaces of two parallel rollers mounted between the said walls, into which chamber the outlet of a suction circuit opens.

FIGS. 8 and 9 illustrate in detail the structure of such apparatus comprising two motorized rollers (1) powered independently of one another and which can move closer together automatically during operation under the effect of the suction produced in the chamber that they form with the side walls, in a way comparable with the teachings of Patent EP 0 224 422.

In this embodiment which therefore incorporates two motorized rollers, the box consists of two end plates between which the two active rollers (1) are mounted, in which the end faces of the sleeve (2) are in sliding contact with the interior faces of the box.

The said rollers (1) are mounted between the side walls (P1) and (P2) not by means of axles secured to the rollers, but via connecting blocks (15, 16), of which the connecting elements (17, 18) which fit into the corresponding parts provided in each roller (1), can slide in slots (21, 22) made in the side walls.

The active rollers (1) are normally held apart via springs which may be built into a recess (28) provided in the lateral blocks (51, 52) and press against a fixed central bearing surface (29) arranged in the central part of the side box (P2).

As in the aforementioned European patent, the suction is produced inside the box, between the rollers (1) through the opening (32) provided in the hood (31) mounted between the two end plates (P1, P2). This suction, during operation, allows the two rollers (1) to move together automatically against the force of the return means which tend to keep the rollers (1) apart, thus allowing the pinching action to be exerted on the fold of skin formed under the action of the said suction.

Sealing valves (33) are arranged inside the side boxes so as to block off the slots (22) as the rollers (1) move.

Moreover, as in the aforementioned patent, pivoting flaps (34) are in contact with the rollers (1) along the entire length of their generator and are fixed inside the hood (31), for example using screws. These flaps remain in constant contact with the rollers (1) and therefore seal the chamber as the rollers move.

In this embodiment, these flaps (34) consist of flexible leaves, the flexibility force tending to keep them in contact with the generator of the rollers as they move closer together.

Figure 10:
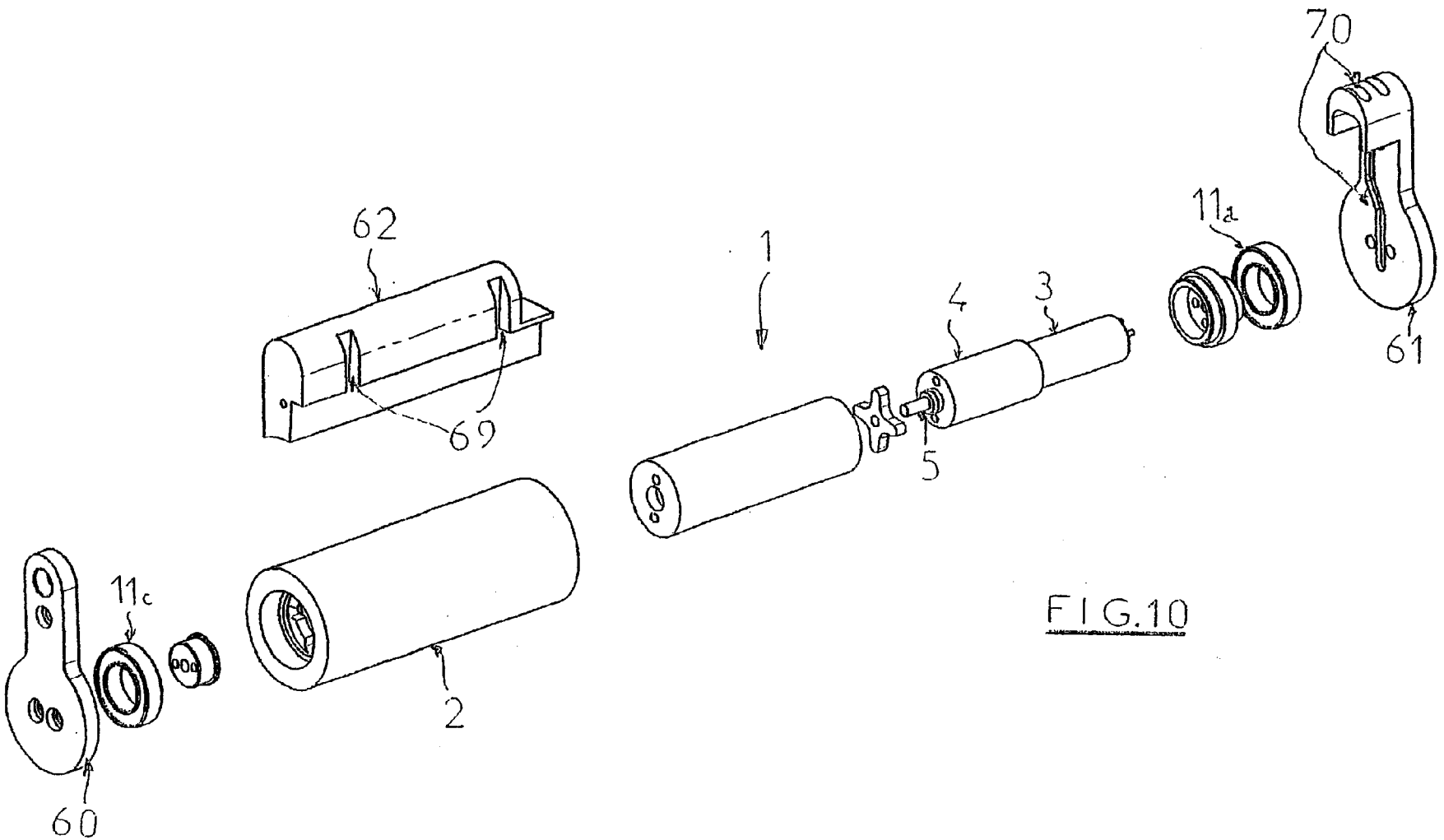
FIG. 10 is an exploded perspective view of an alternative form of a motorized roller according to the invention fixed inside the box via connecting means consisting of two end plates bearing against the walls of the chamber and connected to each other by a crossmember, these means, end plates and crossmembers ensuring sealing when the apparatus is in use.
Figure 11:
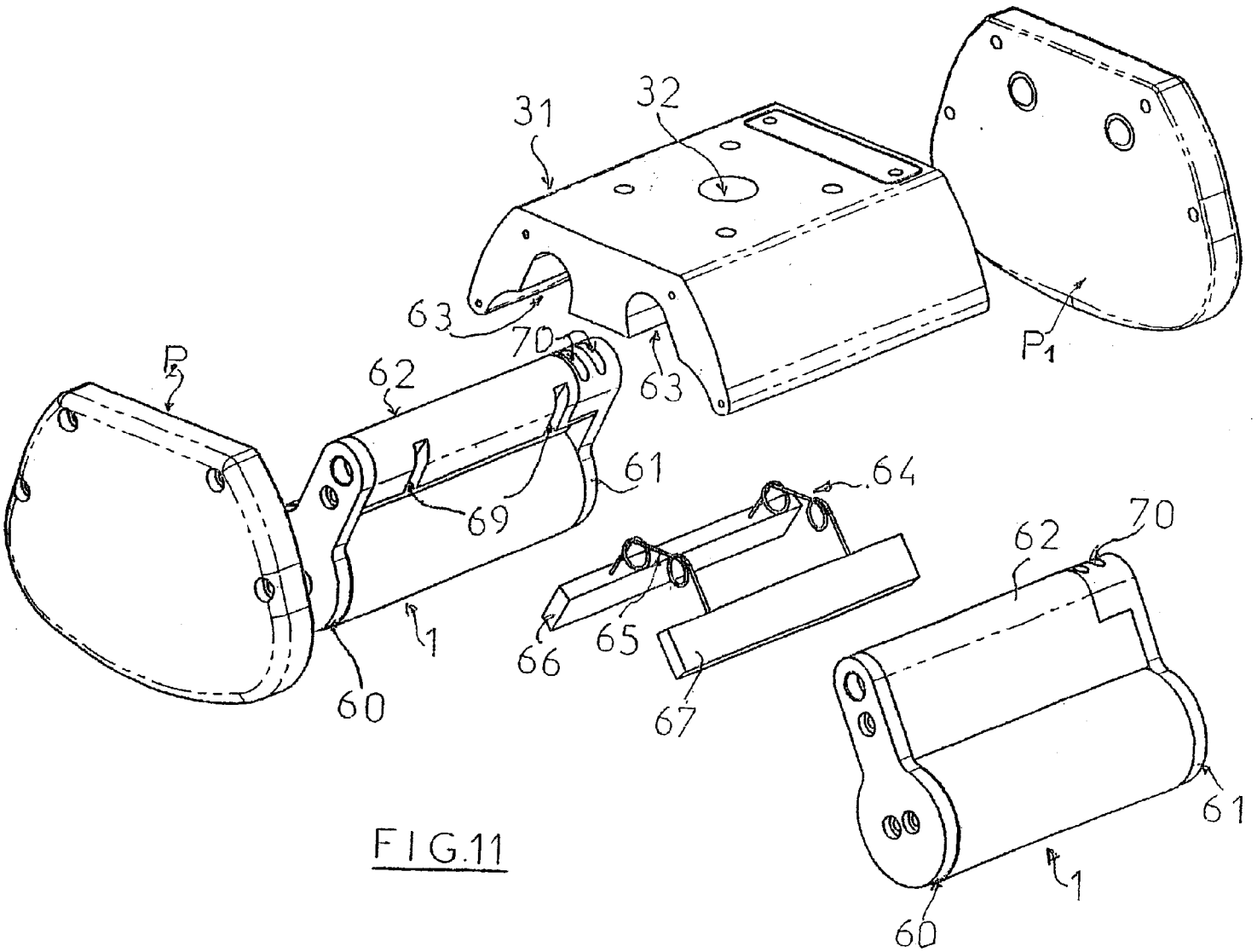
FIG. 11 illustrates, in an exploded view, a massage head comprising two motorized rollers as illustrated in FIG. 10.

FIGS. 10 and 11 illustrate in detail an alternative form of apparatus according to the invention comprising two motorized rollers (1) powered independently of one another and which can move closer together automatically during operation under the effect of the suction produced in the chamber that they form with the side walls (P1) and (P2).

By comparison with the embodiment illustrated in FIGS. 8 and 9, the two rollers (1), the general structure of which is similar to the one described earlier, are mounted between the walls (P1) and (P2) via two end plates (60, 61) in sliding contact with the lateral surfaces (P1, P2) of the box.

These two end plates (60, 61) are joined together by a spacer piece (61), these elements thus forming a fork supporting each of the rollers (1). This fork is mounted so that it can pivot inside cages (63) provided in the bottom of the central body (31) of the box. The central spacer piece (62) and the end plates (60, 61) therefore seal the treatment chamber when the apparatus is in use. The cages (63) serve as a basis of pivoting for the two rollers (1) which are normally held apart by a pressing assembly consisting, for example, of two springs (64, 65) equipped with end stops (66, 67) which come up against the transverse spacer pieces (62). The arms of the springs fit in grooves (69) provided in each crosspiece (62).

In this alternative form, the end plates (61) at their upper part have the electrical connections (70) with the connecting tabs provided on the motor (3, 4) and with the additional means for controlling and monitoring the various functions that the apparatus fulfils, as explained hereinabove in support of the embodiment illustrated in FIGS. 4 to 7. In this embodiment, the motorized roller has a structure similar to the one described previously and will therefore not be detailed again.

The control means for fulfilling the various functions that the apparatus according to the invention has to fulfil, are grouped together inside a control panel connected to the treatment apparatus proper by a flexible line. This control panel therefore comprises:

- a vacuum pump with a built-in motor;
- a panel comprising means allowing the suction inside the head to be monitored;
- means of controlling each of the motorized rollers, consisting for example of an electronic card for controlling and monitoring an electropneumatic slaving sequence, this control being performed individually for each of the rollers so that the direction of rotation and/or the speed of the rollers can be adapted as desired according to the direction of displacement of the head and/or according to the treatment that is to be performed.

It is thus conceivable, when considering a direction of travel, for the front roller to be rotated at a lower speed than the back roller, thus making it possible to have a friction action on the fold of skin formed and to accentuate the formation of the fold while at the same time reducing the amount of suction.

As regards the suction circuit, it may comprise means allowing the pressure and flow rate of air to be varied during operation, for example for an electrically operated valve produced in accordance with the teachings of the document WO 95/09 596, which makes it possible not only to obtain on/off operation, but also to obtain a controlled air flow rate between two predetermined values with the possibility of adjustment between the said values.

The foregoing description clearly shows all the advantages afforded by the invention, particularly the fact that by virtue of the special structure of the motorized rollers according to the invention it is possible to produce a wide variety of new types of treatment and massage and to design massage heads that can be easily dismantled, particularly with a view to servicing them, it being possible for the entire assembly to be designed in the form of a removable unit that can be fitted to the output of the suction circuit proper.

By comparison with apparatus of the prior art, the apparatus according to the invention also has the advantage of obtaining very compact assemblies in which the rollers are readily removable.

Of course, the invention is not restricted to the concrete examples described previously, but also covers all alternative forms thereof which are produced in the same spirit.

What is claimed is:

1. Massage apparatus consisting of a treatment head connected to a suction circuit, said treatment head comprising a box that can be operated manually, said box comprising an internal chamber open at a base thereof, which chamber is sealed when the apparatus is applied to a patient to be treated, said chamber being defined by two fixed side walls and two transverse surfaces arranged facing one another between said side walls, at least one of these transverse surfaces comprising a periphery of a roller driven positively in rotation, the suction circuit opening into said chamber and serving to create suction when the apparatus is applied against the body of the patient, which suction serves to form a fold of skin pressing against the transverse surfaces, wherein a positive drive of the roller is obtained via a geared motor unit mounted fixed and coaxially inside said roller, and wherein an output shaft of a reduction gear of said motor unit (4) comprises means for coupling to said roller, the apparatus being coupled to means for adjusting at least one of a speed and a direction of rotation of the motorized roller and an amount of suction during operation.

2. Apparatus according to claim 1, wherein the at least one transverse surface facing the motorized roller consists of a curved surface, and wherein a spacing between said two transverse surfaces comprises at least one of a fixed and a variable distance during operation.

3. Apparatus according to claim 1, wherein said roller comprises a first roller of two transverse rollers (1), and wherein at least one of said two transverse rollers is motorized, said rollers being mounted on the box and at least one of having a fixed distance between centers thereof and being configured to automatically move closer together under the effect of the suction.

4. Apparatus according to claim 1 further comprising at least one of side valves and pivoting flaps pressing against the roller to seal the chamber formed between the side walls and the surface of said roller when the apparatus is applied against the body of the patient.

5. Apparatus according to claim 1 further comprising means for viewing the fold of skin formed.

6. Massage apparatus according to claim 1 wherein said roller comprises:

- a cylindrical sleeve which can be driven in rotation, at least one of about its geometric axis and around an off-centred axis, said sleeve being mounted at each of its ends on rolling bearings, said roller bearings having fixed bearings which, together with end edges of said sleeve, form side faces of the roller;

the sleeve is driven in rotation about the bearings by said geared motor unit mounted fixed and coaxial to it, and wherein the output shaft of the reduction gear comprises means for coupling with said sleeve;

wherein end edges of the sleeve are in sliding contact with the surfaces of the side walls of the box, said roller being mounted inside said box, said roller being fixed between the side walls, serving to form the treatment chamber via connecting elements which immobilize the geared motor unit inside the sleeve (2) and provide electrical power and connection to additional means for operating and monitoring functions that the apparatus serves to fulfill, said functions comprising:

adjusting the speed and direction of rotation of the roller, the adjusting comprising at least one of programmed and unprogrammed reversal of said roller, and adjusting the amount of suction.

7. Apparatus according to claim 6, wherein a second surface of said two transverse surfaces comprises a second roller of said two transverse rollers and wherein the connecting elements comprise connecting blocks passing through slots provided in the side walls and which can slide in said slots to allow the roller to move closer to said second roller under the effect of the suction.

8. Apparatus according to claim 6, wherein a second surface of said two transverse surfaces comprises a second roller and wherein the connecting elements of the rollers comprise two end plates bearing against the side walls, said end plates being joined together by a transverse spacer piece to form a fork mounted to allow said fork to pivot inside the box and mounted to ensure sealing when the apparatus is applied against the body of the patient, said roller and said second roller normally being held apart and being configured to move closer together under the effect of the suction.

9. Apparatus according to claim 6 wherein said sleeve is covered with a removable sheath at least one of having a hygienic function and acting as a support for a treatment product.

10. Apparatus according to claim 6 further comprising at least one of means for thermally insulating the sleeve while it is in operation and means for allowing said sleeve to heat up.

11. Apparatus according to claim 10 wherein said means for thermally insulating the sleeve comprises means obtained by arranging the geared motor unit inside a tube made of aluminum, which forms an insulating cage and acts as a bearing for one of the rolling bearings provided at the end of each roller, and an inner bearing fixed to the body of the reduction gear supporting an intermediate rolling bearing for the sleeve.

12. Apparatus according to claim 1 wherein the base of the sidewalls of the box are flat or curved, said base being concave or convex.

13. The massage apparatus of claim 6 wherein a second surface of said two transverse surfaces comprises a second roller and wherein the adjusting comprises regulating a speed of said roller and said second roller relative to each other.

14. The massage apparatus of claim 6 wherein a second surface of said two transverse surfaces comprises a second roller and wherein the adjusting comprises regulating a direction of rotation of said roller and said second roller relative to each other.

15. The massage apparatus of claim 6 wherein the adjusting comprises varying the amount of suction during operation.

16. The massage apparatus of claim 6 for further comprising monitoring a pressure exerted by said roller on a fold of skin of the patient.

* * * * *

UNITED STATES PATENT AND TRADEMARK OFFICE

CERTIFICATE OF CORRECTION

PATENT NO. : 6,702,766 B2
DATED : March 9, 2004
INVENTOR(S) : Guitay, Louis Paul It is certified that error appears in the above-identified patent and that said Letters Patent is hereby corrected as shown below:

Title page,
Item [57], ABSTRACT,
delete

"Massage apparatus consisting of a treatment head connected to a suction circuit, the said treatment head comprising a box (B) that can be operated manually, comprising an internal chamber (C) open at its base, which chamber is defined by two fixed side walls (P1,P2) and two transverse surfaces (T1, T2) arranged facing one another between the two side walls (P1, P2), at least one of these surfaces (T1) consisting of the periphery of a roller (1) driven positively in rotation, the suction circuit opening into the said chamber (C) and making it possible to create suction when the apparatus is applied against the body of the patient, which suction tends to form a fold of skin pressing against the transverse surfaces (T1, T2), characterized in that the positive drive of the roller (1) is obtained via a geared motor unit mounted fixed and coaxially inside it, and in which the output shaft (5) of the reduction gear comprises means of coupling to the said roller (1), the said apparatus being associated with means for adjusting the speed and/or direction of rotation of the motorized roller(s) and the amount of suction, possibly varying this, and doing so during operation."

and insert

--A massage apparatus consisting of a treatment head is connected to a suction circuit, the treatment head including a box that can be operated manually, including an internal chamber open at its base, which chamber is defined by two fixed side walls and two transverse surfaces arranged facing one another between the two side walls. At least one of these surfaces consists of the periphery of a roller driven positively in rotation, the suction circuit opening into the chamber and making it possible to create suction when the apparatus is applied against the body of the patient, which suction tends to form a fold of skin pressing against the transverse surfaces. The positive drive of the roller is obtained via a geared motor unit mounted fixed and coaxially inside the roller, and in which the output shaft (5) of the reduction gear includes means of coupling to the roller (1), the apparatus being associated with means for adjusting the speed and/or direction of rotation of the motorized roller(s) and the amount of suction during operation.--

Signed and Sealed this

Twenty-second Day of June, 2004

JON W. DUDAS
*Acting Director of the United States Patent and Trademark Office*